United States Patent [19]

Dickey

[11] Patent Number: 4,844,760

[45] Date of Patent: Jul. 4, 1989

[54] APPARATUS AND METHOD FOR APPLYING

[75] Inventor: Daniel M. Dickey, Denair, Calif.

[73] Assignee: Trine Manufacturing Co., Inc., Turlock, Calif.

[21] Appl. No.: 38,072

[22] Filed: Apr. 14, 1987

Related U.S. Application Data

[63] Continuation-in-part of Ser. No. 910,599, Sep. 23, 1986, abandoned.

[51] Int. Cl.[4] ..... B65C 3/16

[52] U.S. Cl. ..... 156/215; 118/684; 156/64; 156/357; 156/458; 156/578

[58] Field of Search ..... 156/458, 356, 357, 578, 156/64, 215, 218, 453–455, 448–450, 86; 118/684, 685, 672

[56] References Cited

U.S. PATENT DOCUMENTS

| | | | |
|---|---|---|---|
| 4,033,290 | 7/1977 | Dude | 118/266 |
| 4,164,001 | 8/1979 | Patnaude | 118/684 X |
| 4,544,431 | 10/1985 | King | 156/458 X |
| 4,574,020 | 3/1986 | Fosnaught | 156/458 X |

*Primary Examiner*—David Simmons

*Attorney, Agent, or Firm*—Lothrop & West

[57] ABSTRACT

In a labeling machine for a can or bottle, a label on a vacuum drum is wiped on the reverse face near one edge with a solvent and also is sprayed on the reverse face near the other edge with an adhesive, the label then being wrapped around and affixed to the can or bottle to expose the obverse face of the label. Mechanism for accomplishing these actions and for synchronizing adhesive spraying and wrapping speed is disclosed.

14 Claims, 4 Drawing Sheets

FIG. 9
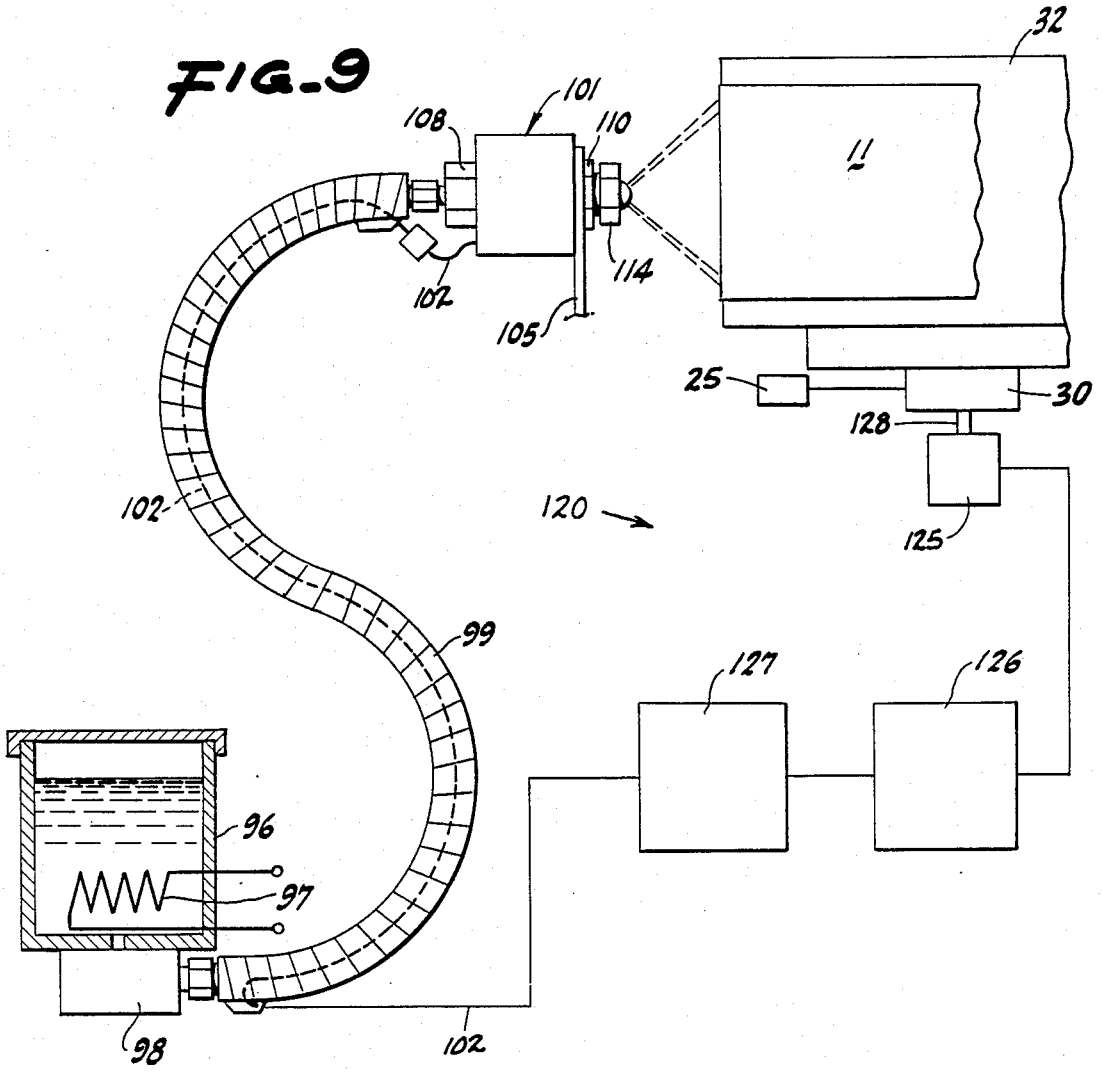
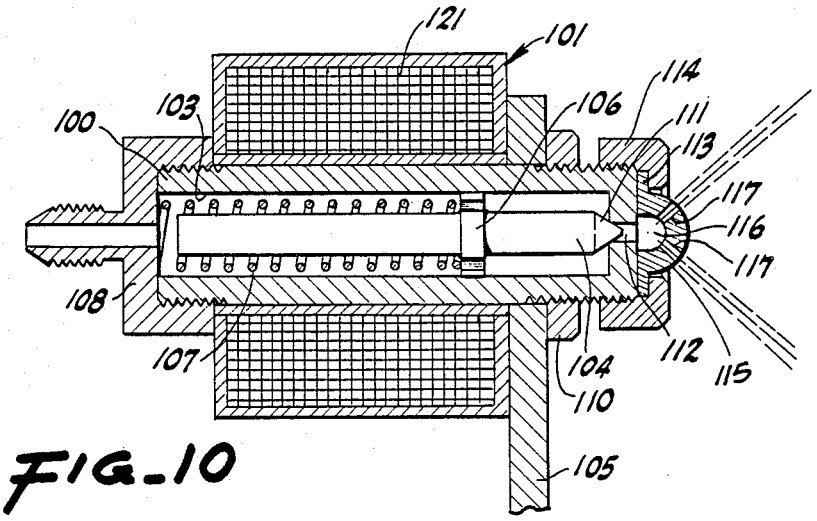
FIG. 10

APPARATUS AND METHOD FOR APPLYING

CROSS REFERENCES TO RELATED APPLICATIONS

This application is a continuation-in-part of my copending application Ser. No. 910,599, filed Sept. 23, 1986, now abandoned.

BACKGROUND OF THE INVENTION

A. Field Of The Invention

The invention relates to an apparatus and method for applying roll-fed labels to bottles, cans, and other containers. More, specifically, the invention embraces the selective application of ejection applied adhesive and wiper applied solvent to the leading and trailing edges, respectively, of the reverse face of solvent-reactive labels, just prior to their contact with a respective container, for adhesion thereto.

B. Description Of The Prior Art

Container labeling machines are well represented in the prior art. U.S. Pat. No. 4,567,681 issued to Fumei and U.S. Pat. No. 4,574,020 granted to Fosnaught, relate to the use of solvents, for applying labels to containers. Neither reference, however, teaches the use of ejection applied adhesive upon the leading edge of the label.

King, U.S. Pat. No. 4,544,431 teaches the ejection application of hot melt adhesive upon the leading edge of a label, while the label is held stationary to ensure accuracy of application; but King's apparatus does not contemplate smooth or continuous movement of the labels as they are adhesive treated and severed from the parent roll.

U.S. Pat. No. 4,033,290 granted to Dude, shows a dual-wick apparatus for coating sheet material with liquid compositions, but does not contemplate the use of gravity and variable vacuum induced means actively to draw the liquid composition through the wicks to effect a uniform application of the composition upon the sheet material.

SUMMARY OF THE INVENTION

An apparatus and method for applying a label to a container includes a frame having a can or bottle transporting structure effective to carry one of a group of cans or bottles individually to a location adjacent a continuously rotating vacuum drum. An individual one of group of labels held on the drum is disposed with its reverse or back face exposed and with its ends precisely positioned. As the vacuum drum continuously advances, a spray nozzle, controlled by a timing mechanism responsive to the rotational position and speed of the vacuum drum, ejects adhesive onto the forward or leading edge of the reverse face of the label. The trailing edge of the label lies upon a raised or outwardly protruding portion of the vacuum drum. As this raised portion of the vacuum drum rotates past the wick element of a solvent applicator, solvent is wipe-applied to the rear or trailing edge of the reverse face of the label. The solvent acts temporarily to soften the contacted portion of the solvent-reactive label. The label, thus prepared, continues to be drum-transported to another location where the leading edge initially comes into adhesive contact with a can or bottle, and whereupon the container is rotated about its axis to secure the trailing edge of the label thereto with the label's obverse face exposed to view.

BRIEF DESCRIPTION OF THE DRAWING

FIG. 9 is a diagram showing the control. storage, and application components of the glue ejection system in combination with a fragmentary representation of the vacuum drum;

FIG. 10 is an axial cross-sectional view, taken to an enlarged scale, showing interior details of the adhesive or glue head, illustrated in FIG. 9.

DETAILED DESCRIPTION OF THE PREFERRED EMBODIMENT

While the present disclosure can be utilized in connection with various different labels and objects that are to be labeled, it has with considerable success been utilized and is described herein as used in connection with a container of a generally right-cylindrical configuration. In cross-section, the cylinder can be square, rectangular, elliptical or, in most cases, circular.

Figure 1:
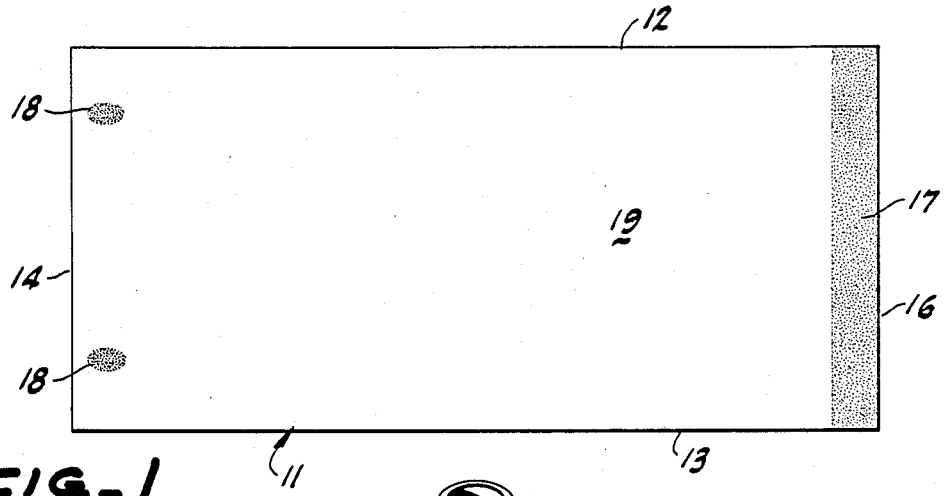
FIG. 1 is a plan view of the reverse side of a label, with appropriate adhesive and solvent applied thereto.
Figure 2:
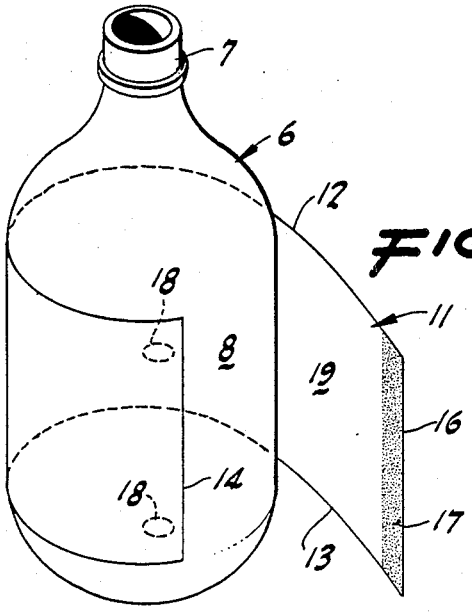
FIG. 2 is an isometric view of a bottle receiving the label of FIG. 1.

For example, as shown in FIG. 2, there is a bottle 6 having the customary neck 7 and having a right circular-cylindrical side wall 8. To be applied to such a side wall, as shown in FIG. 1, is an initially flat film 11, or label, of any of various plastic or other solvent-reactive sheet material, in order effectively to affix the film 11 to the side wall 8 of the container.

Reference is made herein to glue and to solvent, but it should be understood that the labels involved and the containers to which they are affixed vary so greatly in materials and chemical composition that a wide variety of substances to produce adhesion may be employed. It is intended to refer to all of them whether or not they may be currently considered as glues or solvents or both.

The film 11, when flat, customarily is of an elongated, generally rectangular configuration having side edges 12 and 13 as well as a leading edge 14, or end and trailing edge 16, or end. The adhesive areas are, conveniently, an extended transverse stripe 17, across the trailing edge porton of the film, and at least one, but preferably two, spot areas 18 adjacent the leading edge portion. As shown particularly in FIG. 2, the label or film 11 has its reverse or back face 19 put against the side wall 8. Usually the label is long enough so that its 15 ends overlap circumferentially on the container, although that is not essential to practice the invention herein.

Figure 3:
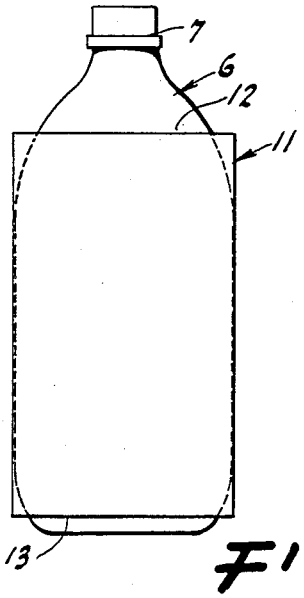
FIG. 3 is a side elevation of a bottle following application of an unshrunk label thereto.
Figure 4:
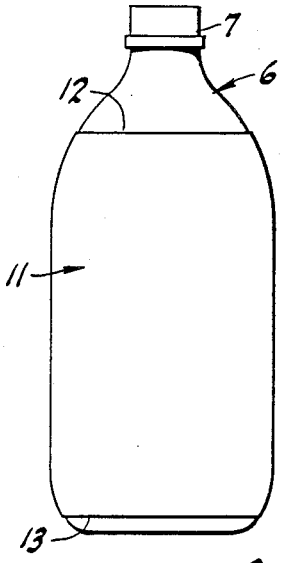
FIG. 4 is a view similar to FIG. 3, but with the label shrunk to conform to the bottle configuration.

As shown particularly in FIG. 3, the film 11 can be of a material which is shrinkable. When it is first applied, the label snugly encircles the container, and upon appropriate well-known treatment, such as the application of heat on and about the label, the film 11 contracts or shrinks so that it conforms very closely to the configuration of the container, even to portions thereof which may not be right circular-cylindrical.

Figure 5:
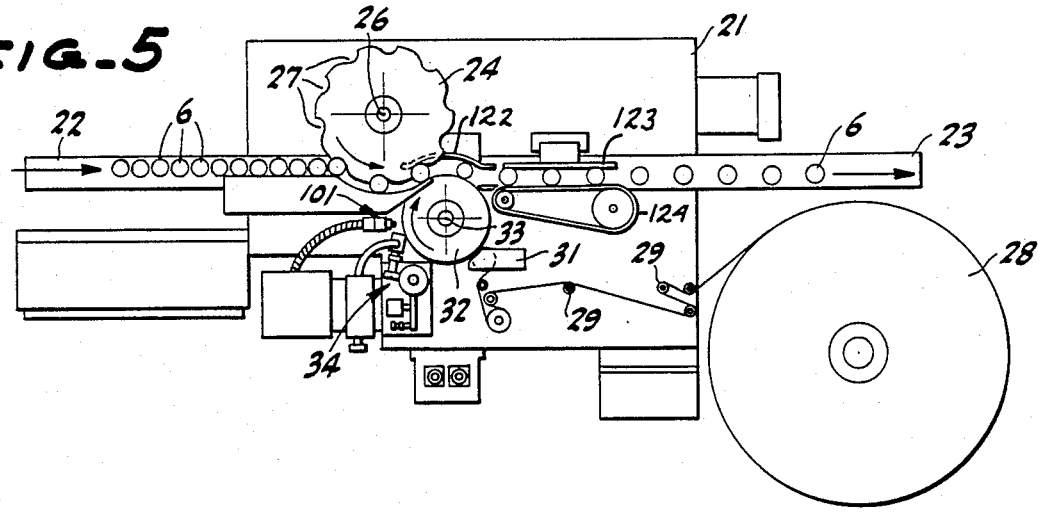
FIG. 5 is a top plan view, generally depicting a machine or apparatus constructed in accordance with the invention.

Automatically and continuously to apply labels or films of the sort disclosed to containers of the indicated nature, there is preferably provided, as shown in top plan in FIG. 5, a framework 21 or housing suitably supported and arranged in an appropriate location to connect with an incoming path 22 or conveyor of containers, cans, bottles or other, customarily right circular-cylindrical objects 6. These are passed through the framework 21 to a discharge path 23 or conveyor. Between the conveyors 22 and 23 there is located a starwheel 24, effective to rotate about a vertical axis 26, the starwheel having a number of indentations 27 or pockets, effective to receive individual cans or bottles from the conveyor 22, and to position and transport them in accordance with the motion of the starwheel. It is evident that containers other than right, circular-cylindrical in configuration would require a starwheel having container pockets of accommodating configuration, or would necessitate some other appropriate container separation and transport mechanism, such as a helical feedscrew. Such container separation and transport mechanisms are well-known in the art, and therefore will not be discussed in any further detail herein.

To supply appropriate films or labels for the containers, there is a label roll 28, located on the framework and adapted to feed a continuous strip of label material through a number of feed rolls 29 to a cutter mechanism 31. This is effective to sever the terminal portion of the continuous film on the roll 28 into a rectangular shape of the sort indicated.

When severed, the obverse side of the segregated label is sucked against the periphery of a vacuum drum 32, rotated continuously at an adjustable predetermined velocity by a drive motor 30 on a vertical axis 33 parallel to the starwheel axis 26 and serving to carry the severed label, in a clockwise direction and away from the severing mechanism, as shown in FIG. 5.

Suitable mechanism, such as an electrical motor controller 25 can be used to vary the vacuum drum speed, and also the overall speed of the labeling apparatus, as desired. In other words, either mechanical or electrical means, not shown but well known in the art, is used selectively to adjust the speed and coordinate the operational relationships of the vacuum drum, the conveyors 22 and 23, the starwheel 24, and feed rolls 29 and cutter 31.

Figure 7:
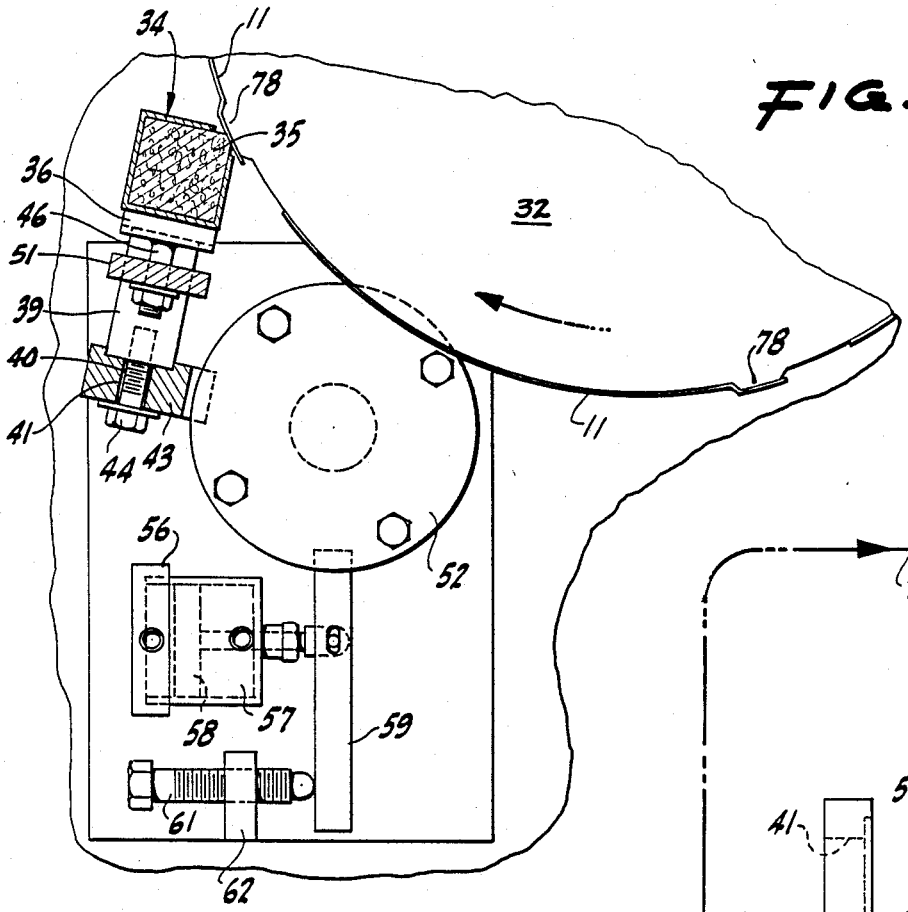
FIG. 7 is a fragmentary top plan, taken to an enlarged scale, and partially in cross-section, showing a portion of the structure for wipe-applying solvent.
Figure 8:
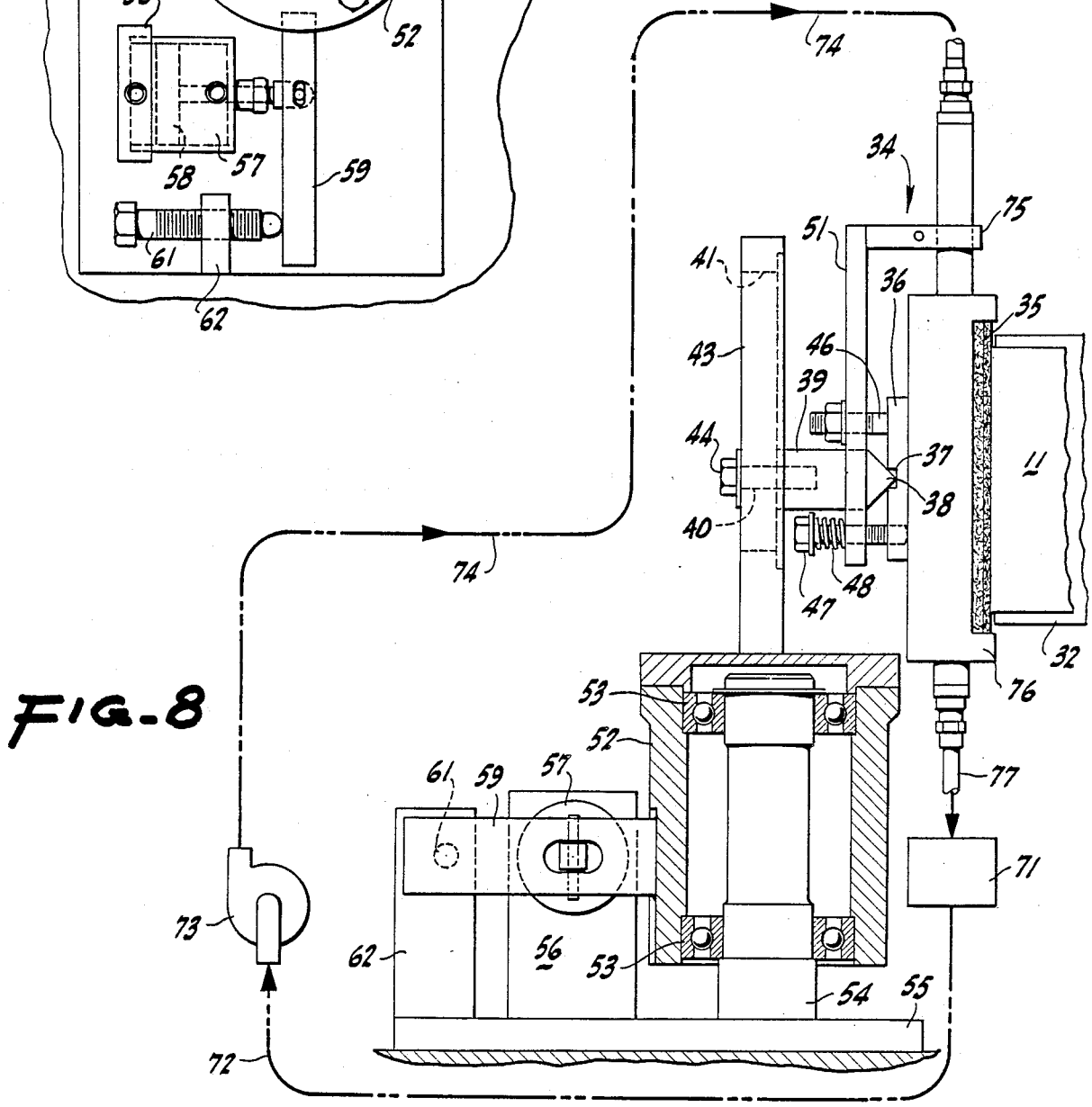
FIG. 8 is an elevational view of the structure shown in FIG. 7, portions being in cross-section and portions being diagrammatic.

The label 11 is carried into juxtaposition with a solvent wiper assembly 34, shown in FIGS. 5 and 7, the wiper assembly 34 being effective to apply an area, or band, or stripe of solvent to the exposed reverse face of the label held on the vacuum drum. The wiper assembly is primarily a body 35, or pad, of felt or sponge-like material on and through which liquid can transfer readily.

The wiper assembly is resilient and yielding for easy conformability. The body 35 is affixed to a block 36 having a depression 37 seated on the apex 38 of a mounting bar 39. The bar 39 includes a stud 40 received in a vertical aperture 41 or slot, extending through a plate 43, the stud 40 being threaded to receive a nut 44 so that there is opportunity for rotary and vertical adjustment of the bar 39 about its axis and with respect to the plate 43. The block 36 is held in position on the apex 38 by an adjustable but firm fastener 46 supplemented by a yielding fastener 47. A spring 48 is interposed between the head of the fastener 47 and a transverse bracket 51 on the bar 39. The wiper assembly 34 can be rotated somewhat and can be adjustably tilted, as necessary, to ensure contact evenly and entirely across and against the face of the raised portions of the vaccum drum.

The plate 43 is radially secured to the outside of a hub 52 carried on ball bearings 53 on a spindle 54 fixed to and extending from a frame plate 55. Upstanding from the plate 55 is bracket 56 that supports a pneumanic cylinder extending from the hub 52. As the cylinder is supplied with air at opposite ends from time to time, the arm 59 is rotated with the hub 52 about the axis of the spindle 54 to limit the positioning of the arm 59, and so the rest of the rotating mechanism, there is provided an adjustable stop bolt 61 threaded into a bracket 62 upstanding from the plate 55 and settable to abut one end of the radial arm 59. By the use of the cylinder 57 and the adjuster 61, the entire wiper pad assembly 34 can be moved away from the vacuum drum 32 and can be returned precisely to a location at an exact radial distance from axis of the vacuum drum.

The purpose of such a position adjustment feature is to displace the assembly 34, and particularly the body 35, radially outward from the raised portions or pads on the surface of the vacuum drum 32. Such an outward displacement of the assembly 34 is necessary to prevent fouling of the vacuum drum when the machine is shut down, or there is no label present upon the adjacent surface of the vacuum drum. The latter condition is typically caused by the depletion of the label roll 28, or a malfunction of the cutter mechanism 31, and is detected by a conventional photocell assembly (not shown), adapted automatically to actuate the pneumatic cylinder 57.

Since the wiper body 35 is a carrier and applicator of adhesive solvent for labels on the vacuum drum, there is afforded a reservoir 71, or tank, for solvent liquid. The solvent is removed from the bottom of the reservoir 71 through a duct 72 leading to a metering pump 73. The pump is appropriately driven to discharge through a line 74, held by a bracket 75, into the vicinity of the wiper body 35, or pad. The solvent drips onto the upper end of the wiper pad 35 and flows by gravity and by capillary action through the pad. This affords a good distribution of solvent over the face of the pad in juxtaposition to the vacuum drum. Excess solvent flowing away from the bottom of the wiper pad is caught by the lower portion of the receptacle 76 or housing and flows through a duct 77 back to the reservoir 71 for recirculation.

During normal operation of the label machine, as described above, individual labels are grasped about the periphery of the vacuum drum and positioned thereon with the majority of the label surface, including the leading edge portion being contingent upon the major surface of the vacuum drum (See FIG. 7). The trailing portion of the label, however, is drawn against axially extending, radially raised portions 78 on the vacuum drum. As the vacuum drum rotates during operation, then, the trailing edge portion of the label is interposed between the outwardly extending raised portion 78 and the wiper pad 35, causing that portion of the label to be wiped with solvent. At all times, the spacing of the remainder of the label is far enough away from the pad 35 so that no solvent is applied thereon.

The effect of the solvent upon the trailing edge of the label material is immediate, as the surface 17 softens, and in effect, becomes partially dissolved. As will become more evident herein, this solvent exposed surface 17 is now prepared to mate and seal, either with the leading edge of the label in a circumferential wrap or with the surface of the container itself, in a partial label wrap.

Figure 6:
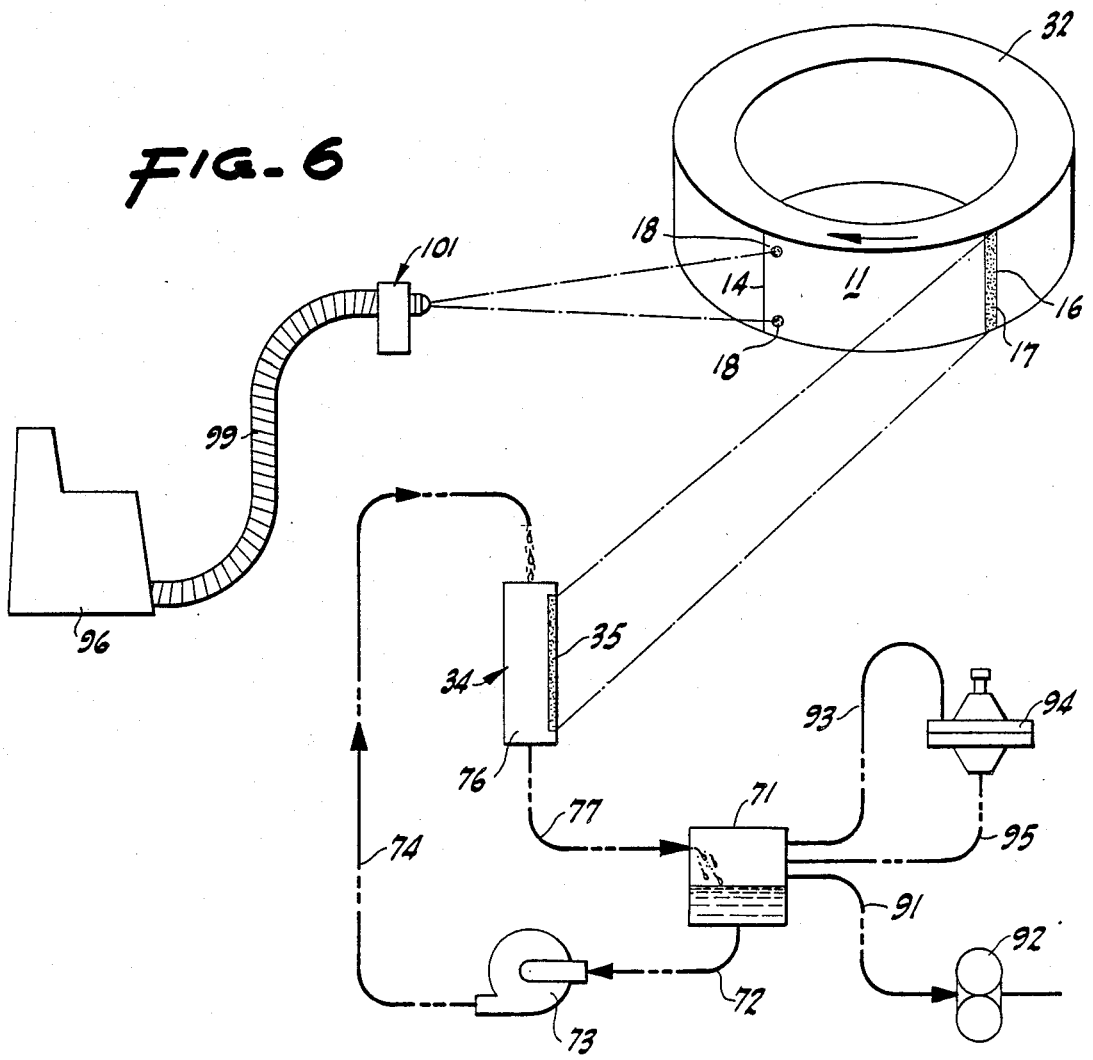
FIG. 6 is a diagrammatic, isometric view, showing related portions of the machine of FIG. 5.

While the return of the solvent to the tank 71 can be simply by gravity, it is preferred that the tank 71 be closed to the atmosphere and that the interior of the tank be subjected to a regulated subatmospheric pressure. As appears most clearly in FIG. 6, a line 91 extends to a regulated vacuum pump 92, while the subatmospheric pressure within the tank 71 is transmitted by a line 93 to one side of a control diaphragm valve 94 that opens and closes under the influence of the pressure in the line 93 to admit atmospheric air from time to time through a line 95 into the solvent tank. This keeps the tank pressure to the desired subatmospheric value, which, in turn, regulates the wetness, or extent of solvent saturation of the wiper pad 35, and removes excess solvent from the lower portion of the pad as well. In short, through selective adjustment of the valve 94, the proper amount of solvent will be evenly distributed through the wiper pad and correspondingly applied to the trailing edge of the label.

As to the supply of adhesive for ejection onto the leading edge portion of the label 11, there is provided an adhesive tank 96 (see FIGS. 6 and 9) that is preferably provided with an appropriate heater 97 to maintain the temperature of the hot melt glue or adhesive within the tank 93. Likewise, connected to the tank there is a pump 98 appropriately driven to draw hot melt adhesive from the interior of the tank and discharge it through an insulated supply tube 99 to a glue head 101.

The glue head 101 is particularly shown in detail in FIG. 10 and includes a body 100 held on a bracket 105 by a nut 110, the body 100 having a hollow cylindrical interior 103 within which is loosely mounted a valve rod 104 having a peripherally scalloped or interrupted flange 106 against which a spring 107 rests. The spring also rests against a cap 108 threaded on the body and having a connection for the tube 99. The spring urges the valve rod 104 to the right (in the figure) so that a tapered head 111 thereon seats in a body opening 112, or passage. On the end of the body 100 is a discharge disc 113 held in place by a surrounding screwed cup 114. The central portion of the disc 113 includes a rounded protuberance 115 providing an interior chamber 116 that communicates with the passage 112 and also communicates with a pair if discharge orificies 117. These orificies are of such a size and are arranged at such an angle as to deposit when the valve is open, the pair of dots 18 or deposits of adhesive adjacent the leading edge portion 14 of the label, on the reverse side thereof.

The timed occurrence of the opening of the valve rod 104 is under the control of a solenoid coil 121 surrounding the body 100 and connected in an appropriately timed circuit. When the solenoid coil is energized, the valve rod 104 is pulled open (moved to the left in FIG. 10) and the adhesive discharge occurs. The coil is shortly thereafter deenergized, whereupon the spring 107 shuts the valve promptly and interrupts the ejection of adhesive.

The timed occurrence and duration of opening of the discharge disc 113 are controlled by an electronic drive synchronizer generally designated by the reference numeral 120 including an encoder 125, or transducer, a camless electronic limit switch 126, and a driver 127. The elements 125,126 and 127 are commercially available and are therefore not described in detail.

The encoder 125 is mechanically interconnected to the hub of the vacuum drum 32 by a shaft 128, or other suitable means, so that the occurrence and frequency of the pulsed electrical output therefrom is determined by the rotational position and speed of the drum 32.

The electronic limit switch 126 is programmable in several areas of operation, to provide an activation signal to the driver 127. These programmable aspects of the synchronizer 120 will be discussed more fully below.

Having sensed the leading edge of the activation signal, the driver 127 is adapted to transmit an initially heightened or accentuated signal through control wire 102 to the solenoid coil 121. The purpose of this initial voltage spike is to overcome the mechanical lag and resistance inherent in the glue gead 101, so that rapid "on" operation of the head is effected. The solenoid coil remains energized thereafter for the duration of the activation signal.

A particularly desirable feature of the invention herein is its adaptability to function reliably over a wide range of container feed speeds. These speeds may vary in the range of about 50 to 400, or so, containers per minute, depending upon the application and upon speed variations encountered between start up and run conditions. The glue head 101, while quick acting, can only operate so fast. Thus, for a fixed glue head position, only a certain range of rotational speeds of the vacuum drum can be accommodated, unless a further adjustable mechanism or additional compensating electrical circuitry is provided.

The electronic limit switch 126 is programmable in the first instance to determine when the activation signal first appears and for what predetermined period. An initial setting for the switch might be to actuate the glue head 101 when the drum 32 is at a 100° rotational position, and deactivate the head 101 at the 105° position of the drum. While this initial setting is satisfactory for relatively low speeds, say 50 to 80 containers per minute, higher speeds of the label machine, and hence the vacuum drum, will cause the glue spots 18 to be applied progressively toward the middle portion of the label rather than upon the intended leading edge. This manner of operation will likely cause malfunction at typical high speeds, since control over the leading edge is lost and label pickup in general is erratic.

Thus, a further programmable feature of the electronic limit switch 126 is the ability automatically to adjust the phase or occurrence of the "window" during which glue ejection occurs. Typically, the timed occurrence of the glue head operation would be shifted forwardly in time some 10°, or so, for each stepped increase in machine speed. In other words, as the machine speed increases from, say, 50 to 130 containers per minute, the glue head would be activated and deactivated, respectively, at the 90° and 95° rotational positions of the vacuum drum. Further phase shifts, or adjustments to the glue head operation period, are made as the label machine speed increases or decreases, and this speed change is sensed by the switch 126 through the encoder 125.

While the discussion above is directed primarily toward an electrical means for synchronizing the operation of the glue head for varying machine speeds, it is also contemplated that mechanical means could be employed as well.

To some extent, radial repositioning of the glue head 101 with respect to the surface of the vacuum drum would effect a quicker or slower application of the glue spots 18 to the label.

One serious limitation with this approach is that a certain minimum distance must be maintained at all times between the cup 114 of the head 101 and the raised portions 78 on the vacuum drum. Thus, unless the head 101 were withdrawn as each raised portion 78 passed by, a speed limitation point would be reached where the head could be moved no closer to the vacuum drum 32, and in particular, the raised portions 78.

Another limitation is that in order to space two glue spots apart a sufficient transverse distance on the leading edge of the label, the discharge orifices 117 directing the glue at a given angle toward the label must be located at a certain minimum radial distance from the label at the time of discharge. In other words, since the orifices are spaced apart at a predetermined angle, the transverse distance between the glue spots is dependent upon the spacing between the orifices and label toward which the orifices are directed.

A more flexible approach is provided by rotationally repositioning the glue head 101 in accordance with the rotational speed of the vacuum drum. Thus, as higher speeds in machine operation are desired, the physical position of the head 101 would be shifted counterclockwise, or upstream, with respect to the vacuum drum, as both components appear in FIG. 5. Radial distance between the head 101 and the drum 32 would remain substantially the same at all times, using this approach.

Mechanical means for actually shifting the head 101, using either approach, could be accomplished by many methods well known to those skilled in the art, and thus need not be explained more fully herein.

It should be noted that at a given drum speed the relative timing of the application of adhesive and solvent to the reverse side of the label depends primarily upon the length of the label an the physical distance between the glue head 101 and the solvent wiper assembly 34. Generally, with longer labels the hot melt adhesive will be ejected upon the leading edge portion of the label before the trailing edge portion reaches the wiper body. On the other hand, a short label will generally require a reverse order of solvent and adhesive application, owing to the physical distance between the head 101 and the solvent wiper assembly 34.

In the operation of the device as a whole, the movable items are properly power driven in synchronism. The bottles or cans or packages come in on the conveyor surface 22, are individually engaged by the rotating starwheel 24 and are thereby spaced and tangentially presented to the adjacent periphery of the vacuum drum 32. At the same time, film material comes from the label roll 28 and is cut into individual labels with their reverse areas exposed. Glue and solvent are applied, as described above, according to the label size and the physical relationship of the glue and solvent applicators. The labels, with adhesive on the leading edge portion and solvent upon the trailing edge portion, and disposed with each leading edge advancing in a clockwise direction on the vacuum drum, come into adhesive contact with a respective passing can or bottle, and adhere thereto to complete the labeling operation.

In the case of right, circular-cylindrical containers, as were primarily referred to and discussed above, this labeling operation is completed by rolling the container and the attached label between the vacuum drum and an opposing, curved roll-on pad 122, spaced from and generally concentric with the vacuum drum, as shown in FIG. 5.

In tha case of a circumferential, or overlap type of label, the solvent treated stripe 17 upon the trailing edge 16 overlaps and seals against the obverse side of the leading edge portion of the label. The solvent acts to bond the two surfaces of the label, forming a secure label wrap around the container.

Where a partial wrap label is employed, the solvent treated stripe 17 would be pressed directly against the container during this roll-on phase of the labeling operation. To form a secure bond, in this case the container, or at least the affected portion of the container, would be solvent reactive in nature and a plurality, for example, three to five glue spots 18 would be applied to the leading end portion of the label instead of the usual one or two glue spots. This could readily be accomplished by increasing the number of discharge orifices 117 in the discharge disc 113.

Further to ensure that the label bond is secure, a secondary roll on pad 123 and downstream driven belt 124 may be employed to complete the process.

In the event that other shaped containers are to be labeled, the label is merely affixed to the container as it passes by the vacuum drum, and generally no further compressive forces need be applied to affix the label securely.

The operation of the device is continuous, and as long as labels, containers, solvent, and adhesive are available, the labeling operation can continue unabated. However, as discussed previously, if the device is shut down or the label supply is depleted, the wiper body 35 is immediately withdrawn from its normal operating position to prevent solvent from being applied to the raised portions 78, before or after the rotating drum comes to rest. The adhesive applicator components are also deactivated under such conditions, by immediate cessation of electrical pulses to the solenoid coil 121. Since the glue head 101 is in a fixed position, it does not need to be physically withdrawn or otherwise moved to prevent contact with or fouling of the vacuum drum during shutdown as does the wiper body. As is evident from the drawings and the discussion above, the glue head 101 is sufficiently removed radially outward from the raised portions, so that the head 101 will never contact the raised portions 78, regardless of the rotational position of the vacuum drum.

I claim:

1. An apparatus for applying a label to a container, comprising:

(a) a frame;

(b) a vacuum drum mounted for continuous rotation on said frame, said vacuum drum having at least one axially extending, radially raised portion on its outer periphery;

(c) container conveying means mounted on said frame for spacing and then tangentially presenting individual containers to an adjacent periphery of said vacuum drum;

(d) means for supplying a label to said outer periphery of said vacuum drum, said label having an obverse side and a reverse side and a leading edge and a trailing edge , said label being positioned on said drum with said reverse side exposed and said trailing edge upon said raised portion of said drum;

(e) means on said frame for wiping solvent onto the raised and exposed trailing edge of said label in advance of rotation of said label to said adjacent periphery of said drum, said solvent wiping means being outwardly spaced from said outer periphery a sufficient distance so that said wiping means comes into contact solely with said raised trailing edge of said label; and, (f) means on said frame for ejecting adhesive onto the exposed leading edge of said label in advance of rotation of said label to said adjacent periphery of said drum, for tangential adhesive engagement with a container, said adhesive ejecting means being outwardly spaced from said outer periphery a sufficient distance to prevent contact between said ejecting means and said raised portion of said drum.

2. An apparatus as in claim 1 in which said solvent wiping means includes a solvent tank on said frame for containing solvent, a wiper pad, and means for transferring solvent from said solvent tank to the upper end of said wiper pad.

3. Apparatus as in claim 2 in which said adhesive ejecting means includes an adhesive tank on said frame for containing adhesive, a spray nozzle, means on said frame for holding said spray nozzle in position to discharge spray toward said vacuum drum, and means for transferring adhesive from said adhesive tank to said nozzle.

4. Apparatus as in claim 3 including means for selectively adjusting the rotational velocity of said vacuum drum.

5. Apparatus as in claim 4 including means for automatically synchronizing said adhesive ejecting means with the rotational velocity of said vacuum drum and the position of said label relative to said adjacent peripheral element of said vacuum drum.

6. Apparatus as in claim 5 in which said automatic synchronizing means includes electronic encoding means connected to said vacuum drum for emitting a pulsed output signal having a frequency dependent upon the rotational velocity and relative angular position of said label on said vacuum drum; electronic limit switch means for detecting the characteristics of the output signal of said encoding means and providing an activation signal in dependence thereon; and electronic driver means connected to said limit switch means for sensing said activation signal and transmitting a responsive electrical actuating signal to said adhesive ejecting means.

7. Apparatus as in claim 6 in which said limit switch means is programmable to function over a range of container feed speeds on the order of about 50 to about 400 containers per minute.

8. Apparatus as in claim 7 in which said limit switch means is further programmable automatically to shift the glue ejection phase forwardly or backwardly in relation to respective increased or decreased container feed speed.

9. Apparatus as in claim 5 in which said synchronizing means includes means responsive to the speed of said vacuum drum for radially moving said adhesive ejecting means toward or away from said vacuum drum in direct relation to higher or lower drum speed respectively.

10. Apparatus as in claim 5 in which said synchronizing means includes means responsive to the speed of said vacuum drum for shifting said adhesive ejecting means circumferentially with respect to the outer periphery of said vacuum drum, the shift being in an upstream direction for higher container feed speeds and in a downstream direction for lower container feed speeds.

11. An apparatus as in claim 2 in which said solvent wiping means further includes means for collecting excess solvent flowing from the lower portion of said wiper pad and returning the solvent to said solvent tank, and selectively adjustable vacuum means connected to said solvent tank for regulating the extent of solvent saturation of said wiper pad.

12. A method of applying a label to a circular cylindrical body of a container comprising the steps of:

a. disposing the obverse side of a label about the periphery of a continuously rotating cylindrical drum, having at least one axially extending, radially raised portion to displace the trailing edge of the reverse side of said label outwardly;

b. ejecting an adhesive only onto the leading edge of said label, from a location removed radially outwardly from said raised portion;

c. wipe-applying a solvent only onto the trailing edge of said label, as it comes into contact with a solvent applicator spaced slightly from said periphery of said drum;

d. continuously conveying containers in spaced relation, and tangentially presenting individual containers to an adjacent periphery of said vacuum drum for contacting said leading edge of an individual label;

e. rotating said container and said attached label between said drum and an opposing curved roll on pad.

13. A method as in claim 12 in which the order of steps (b) and (c) is reversed.

14. A method as in claim 12 or 13 including the step of automatically synchronizing the speed of applying adhesive to said reverse face near the other of said ends with the speed of positioning said label around said body as the label positioning speed is varied.

* * * * *

UNITED STATES PATENT AND TRADEMARK OFFICE

CERTIFICATE OF CORRECTION

PATENT NO. : 4,844,760

DATED : July 4, 1989

INVENTOR(S) : Daniel M. Dickey

It is certified that error appears in the above-identified patent and that said Letters Patent is hereby corrected as shown below:

The correct title of the invention is:

APPARATUS AND METHOD FOR APPLYING A LABEL TO A CONTAINER

Signed and Sealed this

Twenty-seventh Day of February, 1990

*Attest:*

JEFFREY M. SAMUELS

*Attesting Officer*

*Acting Commissioner of Patents and Trademarks*